US009114272B2

(12) United States Patent
Fowler

(10) Patent No.: US 9,114,272 B2
(45) Date of Patent: Aug. 25, 2015

(54) PORTABLE ADJUSTABLE MULTI-PURPOSE EXERCISE DEVICE

(71) Applicant: Douglas Fowler, Apopka, FL (US)

(72) Inventor: Douglas Fowler, Apopka, FL (US)

(73) Assignee: DONKEY SIT FITNESS, LLC, Apopka, FL (US)

( * ) Notice: Subject to any disclaimer, the term of this patent is extended or adjusted under 35 U.S.C. 154(b) by 207 days.

(21) Appl. No.: 13/771,404

(22) Filed: Feb. 20, 2013

(65) Prior Publication Data

US 2013/0237394 A1 Sep. 12, 2013

Related U.S. Application Data

(60) Provisional application No. 61/685,130, filed on Mar. 12, 2012.

(51) Int. Cl.

| | |
|---|---|
| ***A63B 21/068*** | (2006.01) |
| ***A63B 71/00*** | (2006.01) |
| ***A63B 26/00*** | (2006.01) |
| ***A63B 21/00*** | (2006.01) |
| ***A63B 17/00*** | (2006.01) |
| ***A63B 23/12*** | (2006.01) |

(52) U.S. Cl.

CPC ..... *A63B 21/00* (2013.01); *A63B 17/00* (2013.01); *A63B 21/00047* (2013.01); *A63B 23/1218* (2013.01); *A63B 23/1236* (2013.01); *A63B 2210/50* (2013.01); *A63B 2225/09* (2013.01)

(58) Field of Classification Search

CPC ..... A63B 21/0728; A63B 21/075; A63B 21/1469; A63B 21/0724; A63B 21/00047; A63B 21/072; A63B 21/0557; A63B 21/1457

USPC ..... 482/92–98, 104, 106–108, 133, 141, 482/142, 148, 907–908; D21/679–680, D21/686, 690, 823; 403/1, 6–7

See application file for complete search history.

(56) References Cited

U.S. PATENT DOCUMENTS

| | | | | | |
|---|---|---|---|---|---|
| 4,838,250 | A * | 6/1989 | Angelo | 606/237 |
| 5,389,055 | A * | 2/1995 | Gangloff | 482/38 |
| 5,527,242 | A * | 6/1996 | Gangloff | 482/38 |
| 5,630,776 | A * | 5/1997 | Yang | 482/104 |
| D424,141 | S * | 5/2000 | Eckmann | D21/686 |
| D454,930 | S * | 3/2002 | Novak | D21/686 |
| D469,293 | S * | 1/2003 | Harms | D6/552 |
| D469,294 | S * | 1/2003 | Harms et al. | D6/552 |
| 6,712,744 | B2 * | 3/2004 | Buechel et al. | 482/142 |

(Continued)

*Primary Examiner* — Oren Ginsberg
*Assistant Examiner* — Andrew S Lo
(74) *Attorney, Agent, or Firm* — Antonio G. Tapia

(57) ABSTRACT

A new and useful portable adjustable multi-purpose exercise device which is collapsible when not in use, relatively inexpensive, allows for a multitude of exercises to be performed for every major part of the body and focuses on exercises which implement the user's body weight as resistance. The device essentially comprises two triangular support frames and an attached stabilizer bar, which when assembled yields a pyramidal prismatic structure upon which the user performs a variety of exercises. The configuration of the device changes as the user optionally places an exercise grip bar in various receiving grooves. This device is believed to be useful in the home setting, whereby the individual user may obtain a full work-out without the need for larger home gym systems. A device according to the invention is also believed to be favorable for use in large gym environments, hospital therapy rooms, classes and other fitness-related facilities.

1 Claim, 6 Drawing Sheets

(56) References Cited

U.S. PATENT DOCUMENTS

| | | | | |
|---|---|---|---|---|
| 6,926,649 | B2 * | 8/2005 | Slawinski | 482/104 |
| D528,612 | S * | 9/2006 | Black | D21/686 |
| 7,278,959 | B2 * | 10/2007 | Brown, III | 482/104 |
| D565,132 | S * | 3/2008 | Lien et al. | D21/686 |
| 7,628,734 | B1 * | 12/2009 | Proctor | 482/74 |
| 7,637,851 | B1 * | 12/2009 | Lormil | 482/95 |
| 7,713,179 | B2 * | 5/2010 | Webber | 482/104 |
| 7,727,129 | B1 * | 6/2010 | Goddard | 482/104 |
| 7,909,743 | B1 * | 3/2011 | Webber | 482/104 |
| 8,328,698 | B1 * | 12/2012 | Webber et al. | 482/104 |
| 2001/0004624 | A1 * | 6/2001 | Cournoyer | 482/141 |
| 2005/0272574 | A1 * | 12/2005 | Lessard | 482/104 |
| 2007/0042876 | A1 * | 2/2007 | Lundquist | 482/94 |
| 2007/0203002 | A1 * | 8/2007 | Webber | 482/104 |
| 2008/0220951 | A1 * | 9/2008 | Webber | 482/98 |
| 2009/0105052 | A1 * | 4/2009 | Dalebout et al. | 482/133 |
| 2009/0124469 | A1 * | 5/2009 | Webber et al. | 482/98 |
| 2011/0300998 | A1 * | 12/2011 | Sullivan | 482/94 |
| 2012/0142506 | A1 * | 6/2012 | Hetrick et al. | 482/142 |
| 2012/0329613 | A1 * | 12/2012 | Schiano | 482/94 |

* cited by examiner

PORTABLE ADJUSTABLE MULTI-PURPOSE EXERCISE DEVICE

CROSS-REFERENCE TO RELATED APPLICATIONS

This Application claims the benefit of U.S. Provisional Application No. 61/685,130, filing date Mar. 12, 2012.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

TECHNICAL FIELD

This invention relates generally to exercise equipment. More specifically this invention relates to portable, collapsing, and adjustable exercise equipment.

BACKGROUND OF THE INVENTION

In the current art exercise equipment comes in various forms. Most typically exercise equipment commonly referred to in the industry as "home gyms" comprise large machines that allow a user to perform a multitude of exercises. Often these home gyms are systems which incorporate a large metal frame and house weight plates, bars, and benches thereupon. A user of a current home gym system engages the home gym by selecting weight or resistance as indicated by a desired exercise and then grasping a bar, handle or sitting upon a seat. The user then performs the desired exercise as needed. These systems are usually expensive, require large spaces to house, and are very heavy and immobile once assembled. In the alternative, athletes must join a gym and pay a monthly membership for the privilege of access to similar exercise equipment. This of course is unfavorable as it incurs ongoing expense, and has limited access to the equipment while in use by another member or when the gym is closed for business.

In the applicant's experience there is a deficiency in the existing and prior art wherein there are no sufficiently lightweight, inexpensive, portable, adjustable and collapsible multi-purpose exercise devices. Further, there is a problem in the current art where there are no dependable and adjustable exercise devices that utilize the user's bodyweight to provide resistance during a workout routine. If there is a device that does so, for example a pull-up bar that attaches to a home door frame, the device is often limited to only a few exercises or only one part of the body.

In the applicant's experience, there is a need for an exercise device which is i) portable, ii) adjustable, iii) collapsible when not in use, iv) relatively inexpensive, v) allows for a multitude of exercises to be performed for every major part of the body, and vi) focuses on exercises which implement the user's bodyweight as resistance. The device of the present invention is believed to accomplish all of the foregoing objectives.

SUMMARY OF THE INVENTION

The present invention provides a new and useful portable adjustable multi-purpose exercise device which is collapsible when not in use, relatively inexpensive, allows for a multitude of exercises to be performed for every major part of the body and focuses on exercises which implement the user's body weight as resistance. This device is believed to be useful in the home setting, whereby the individual user may obtain a full work-out without the need for current home gym systems. A device according to the invention is also believed to be favorable for use in large gym environments, hospital therapy rooms, classes and other fitness-related facilities.

In one of its basic embodiments, the basic invention comprises two support frames which are generally triangular and made from a substantially rigid and weight bearing material such as extruded aluminum with a rectangular cross-section. These support frames resemble isosceles triangles having two sides joined at an apex and a base running below, attached to the sides and running approximately parallel to the ground when the device is assembled. In this embodiment, four receiving grooves are cut into the support frame along the length of each side of the triangle. These support grooves comprise a geometry that allows for the insertion of a grip bar into the groove. The geometry of the groove also includes a narrower notch wherein the threaded male screw end of a knob can be inserted and tightened to affix the grip bar to the frame when in use. The orientation, elevation, and orientation of the grip bar when connected to the support frames is dictated by the exercise sought and periodically adjusted by the user.

In this embodiment, the support frame also has a base receiving groove along the base of the support frames. This base receiving groove exhibits a geometry that is unique and complimentary to a tab on either end of a stabilizer bar. The stabilizer bar is used to firmly hold the support frames in a vertical position when the device is assembled, has a generally flat cross section and is made from similar materials as the support frames. This stabilizer bar is oriented and attached to both support frames at a perpendicular angle. This is accomplished by insertion of the tabs into the base receiving grooves of the support frames. Like the grip bar, the stabilizer bar is rigidly fastened to the support frames by use of knobs. These knobs exhibit a male threaded screw at one end which is complimentary and unique to the female threaded screw channels on the support bar. When assembled the knobs can be sufficiently tightened by the user of the device in order to yield a rigid structure on which to perform exercises.

In this embodiment the exercise grip bar has a generally circular cross section, and has two grips along the length of the bar. The grips are made from a spongy material such as foam rubber. Also, this embodiment features four rubberized feet attached to the underside of the base sides of the support frames. The feet act to cushion the device while in use, protect the floor or surface underneath and also attenuate any shaking or movement when in use.

When the device is in use, the user places the support frames on a flat and stable floor with ample room that allows for performance of varied exercise routines. The user then attaches the stabilizer bar to the support frames of the device by inserting the stabilizer bar tabs into the base receiving grooves of the support frames. The user then firmly and rigidly affixes the stabilizer bar to the support frames by inserting the male threaded screw end of a fastening knob through support frame and into a receiving female threaded screw channel in either end of the stabilizer bar. The user then tightens the knobs completely. Once tightened, the device is considered to be assembled and generally represents a pyramidal prismatic shape, with the support frames oriented vertically and perpendicular from the ground; the stabilizer bar oriented perpendicularly between the support frames and running parallel and flush to the ground.

When in use, the user then elects an exercise and places the exercise grip bar into a series of receiving grooves along the front or back side of the support frames. The user then rigidly affixes the exercise grip bar to the frames by use of threaded knobs.

Once the exercise grip bar is firmly in place, the user performs the exercise as directed. This is usually accomplished by pushing or pulling her body weight against the bar and device for a series of repetitions. One example of an exercise is an inverted row where the user pulls herself up towards the recently affixed exercise grip bar on the assembled device.

Thus the present invention provides a new and useful exercise device which is i) portable, ii) adjustable, iii) collapsible when not in use, iv) relatively inexpensive, v) allows for a multitude of exercises to be performed for every major part of the body, and vi) focuses on exercises which implement the user's bodyweight as resistance. The device of the present invention is believed to accomplish all of the foregoing objectives.

Further features and objectives of the present invention will become apparent form the following detailed description and the accompanying drawings.

DETAILED DESCRIPTION OF THE INVENTION

Figure 1:
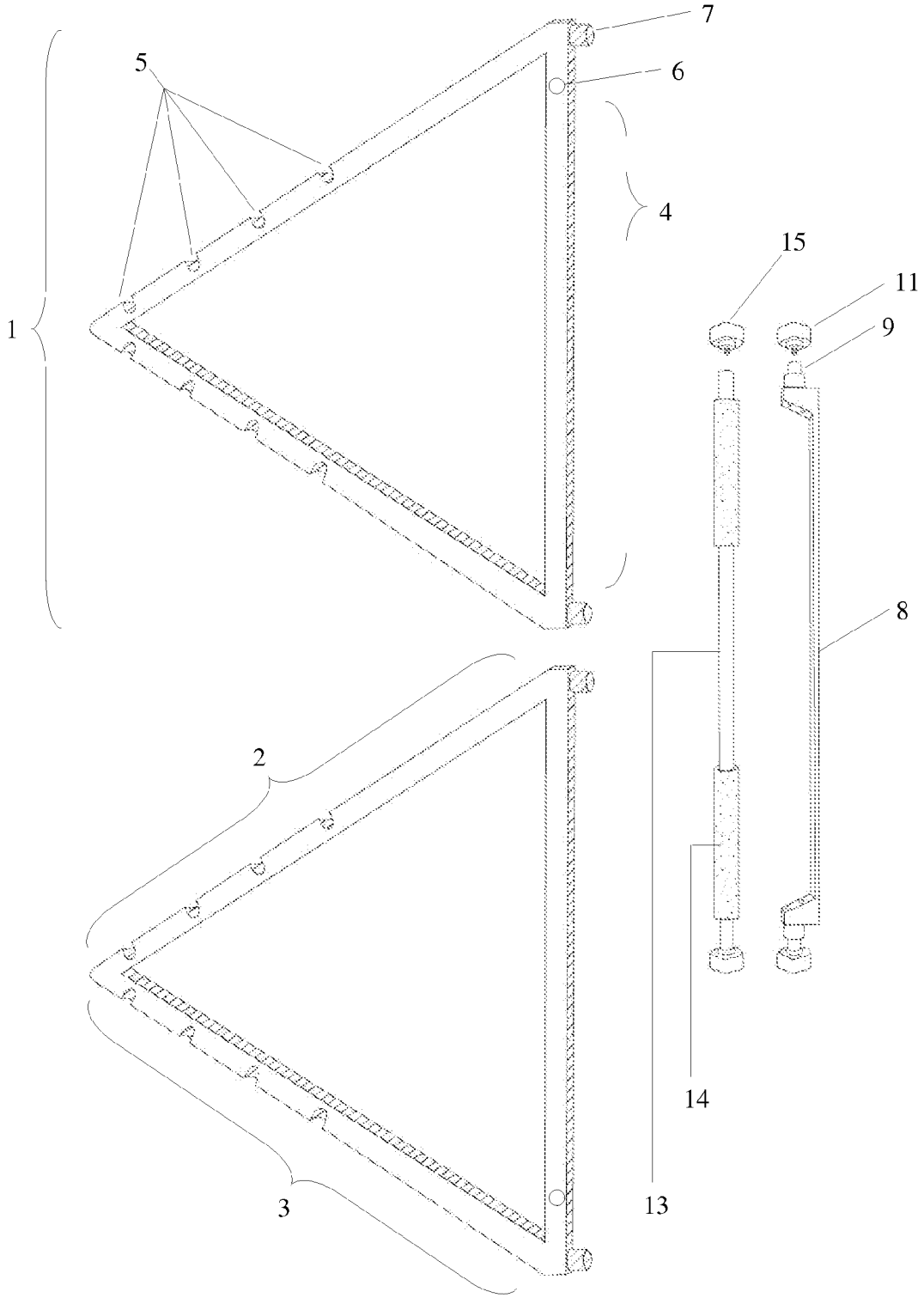
FIG. 1 is a front elevation view of a portable adjustable multi-purpose exercise device shown disassembled into component parts according to the present invention.
Figure 2:
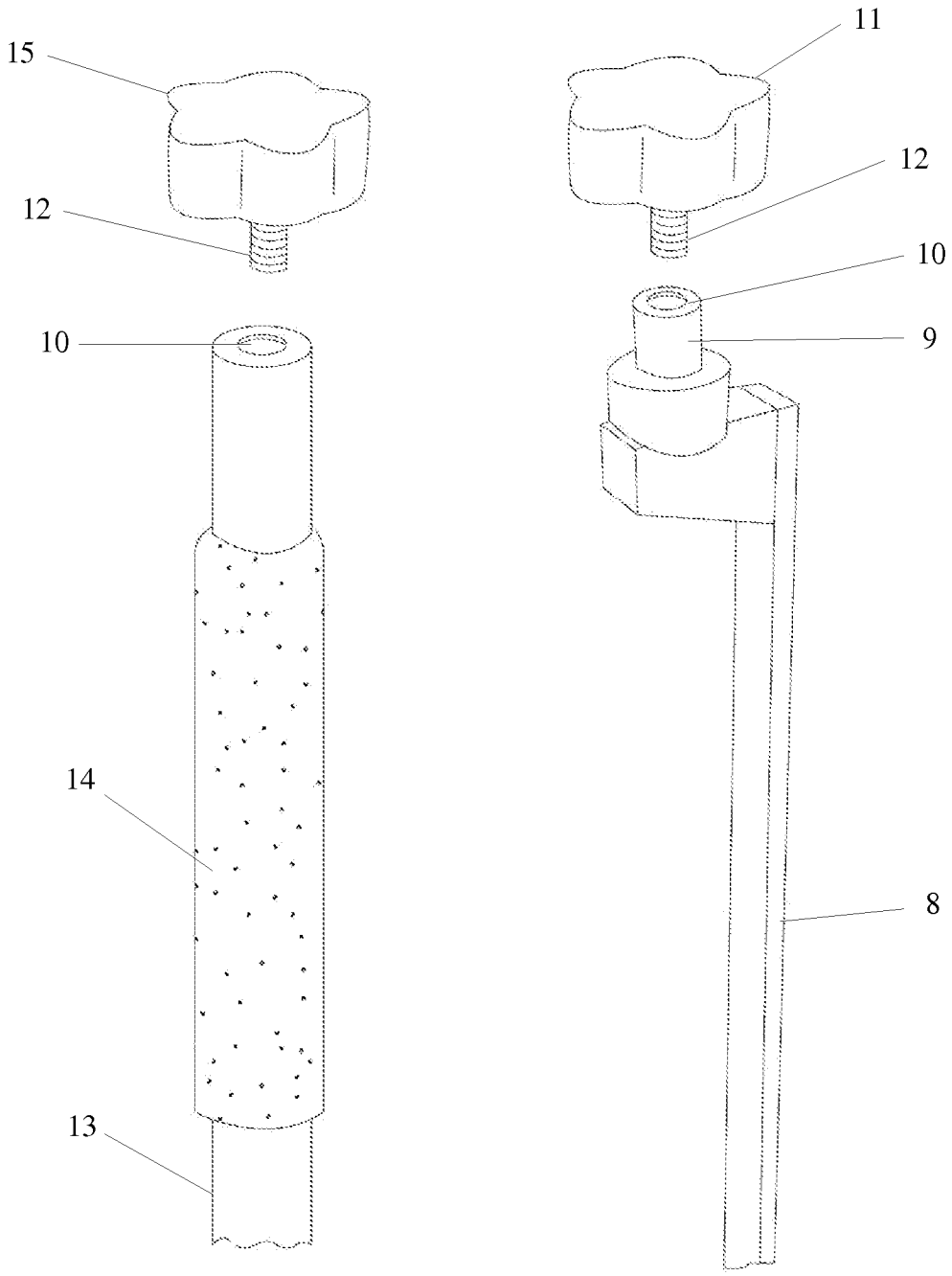
FIG. 2 is a detail view of the exercise grip bar and stabilizer bar, the ends and respective fastening knobs used in assembly of the device.
Figure 3:
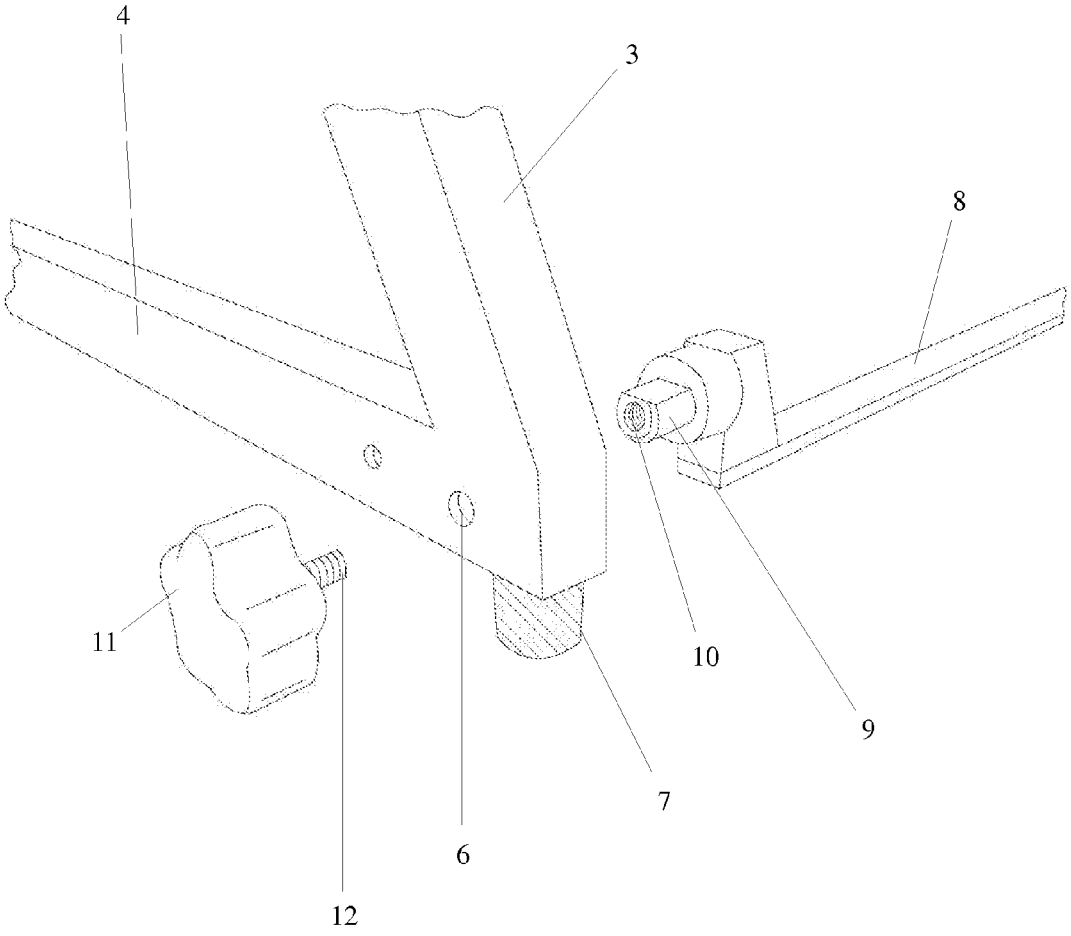
FIG. 3 is a perspective view detail of the device during assembly, where the stabilizer bar is inserted into a base receiving groove on the base of the support frame and secured by the stabilizing bar fastening knob.
Figure 4:
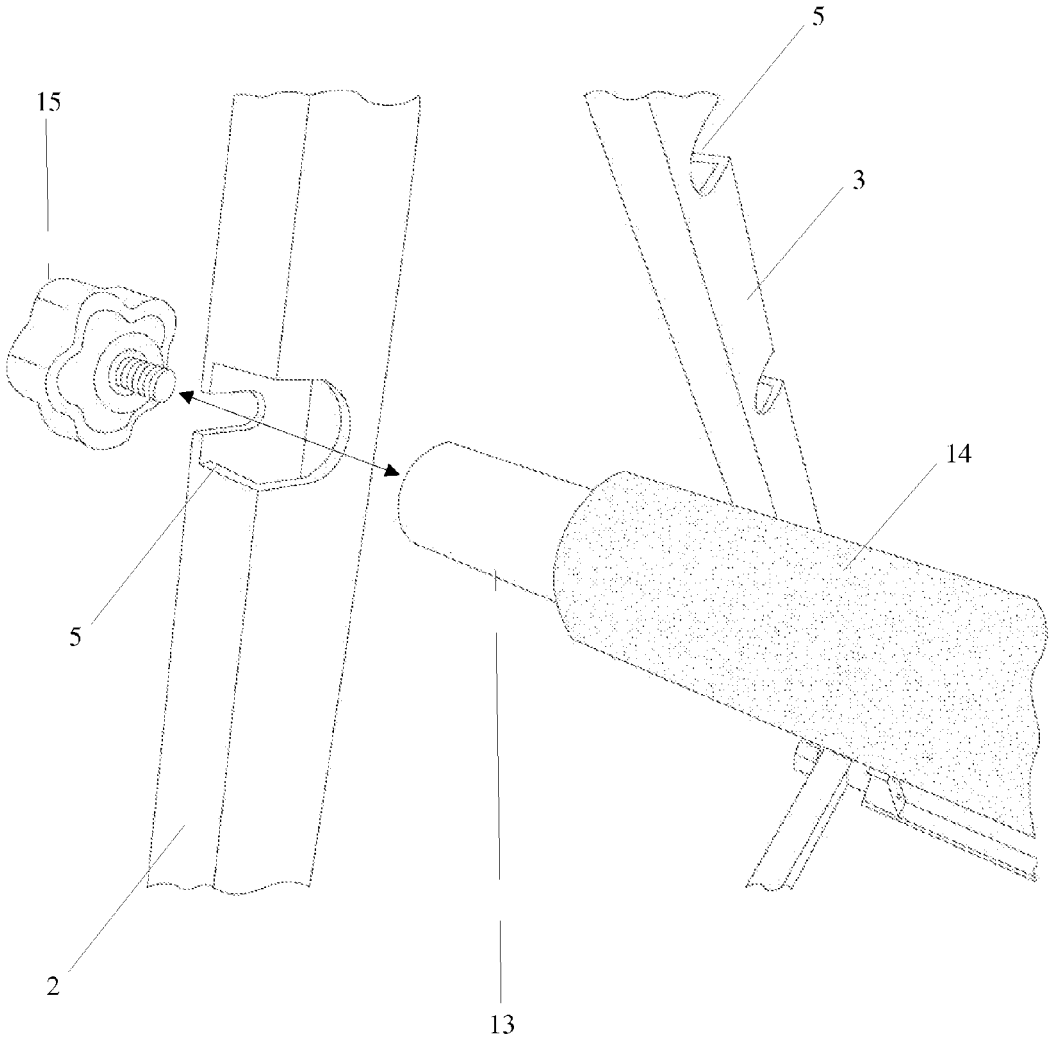
FIG. 4 is a perspective view detail of the device during assembly, where the exercise grip bar is inserted into a receiving groove on the front side of the support frame and secured by the exercise grip bar fastening knob.
Figure 5:
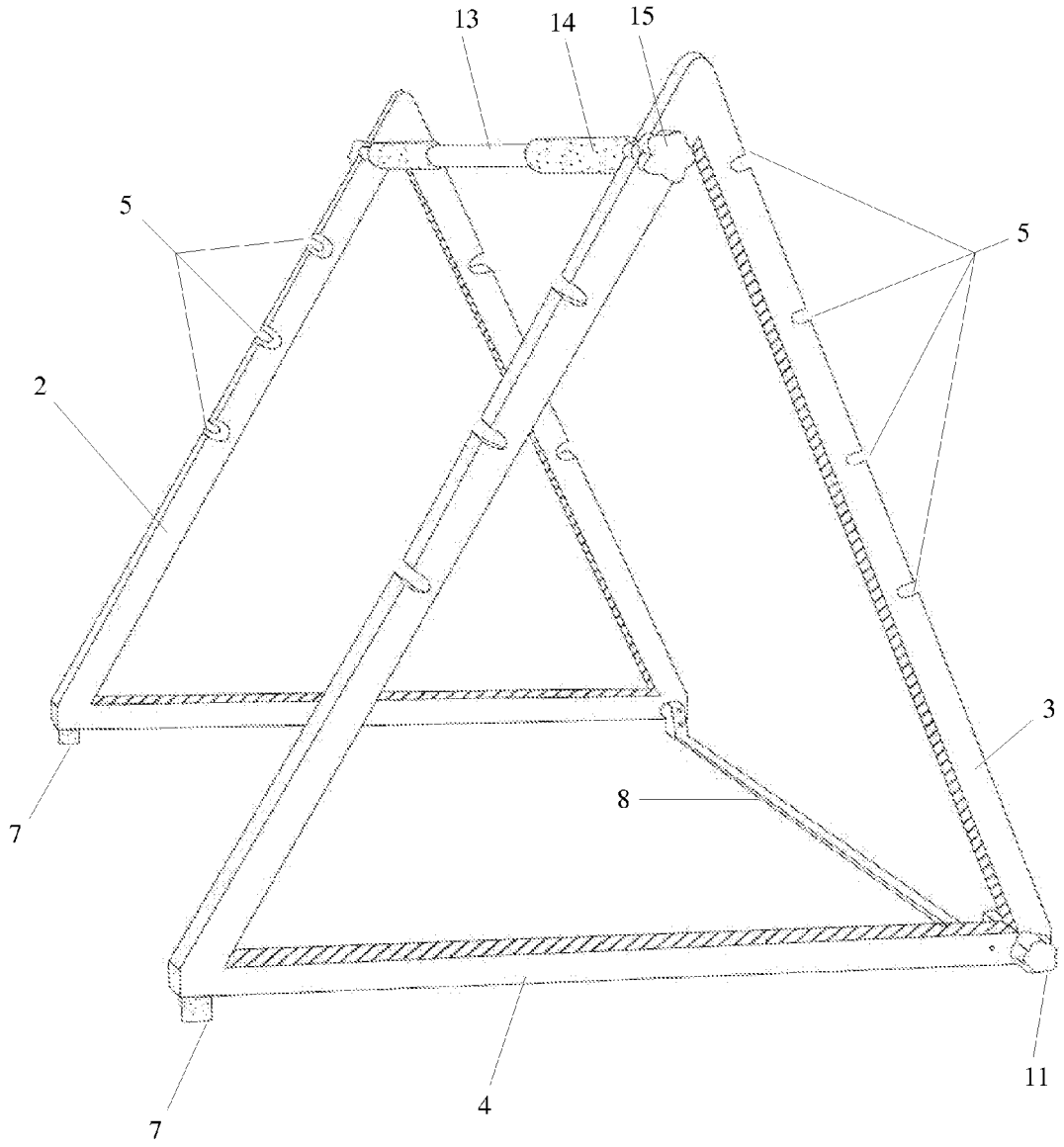
FIG. 5 is a perspective view of a portable adjustable multi-purpose exercise device shown assembled with the exercise grip bar in the top front receiving groove generally and according to the present invention.

As described above, the present invention provides a new and useful portable adjustable multi-purpose exercise device which is collapsible when not in use, relatively inexpensive, allows for a multitude of exercises to be performed for every major part of the body and focuses on exercises which implement the user's body weight as resistance. This device is believed to be useful in the home setting, whereby the individual user may obtain a full work-out without the need for current home gym systems. A device according to the invention is also believed to be favorable for use in large gym environments, hospital therapy rooms, classes and other fitness-related facilities.

Referring now to the invention in more detail in FIG. 1 to FIG. 6 there is shown a portable adjustable multi-purpose exercise device comprising two support frames 1 which are generally triangular and made from substantially rigid material such as extruded aluminum, hard plastic or equivalent. Each support frame 1 having a front side 2, a back side 3 and a base 4. Four receiving grooves 5 are cut into the length of each of the front side 2 and the back side 3 of the support frames 1.

A base receiving groove 6 is drilled through the support frames 1 along the length of the base 4. Two rubberized feet 7 are attached to the base 4 of each support frame 1 as well.

The invention further comprises a stabilizer bar 8 having a generally flat cross section, and a tab 9 on each end. A threaded female screw channel 10 is located in the approximate center of each tab 9. When the device is assembled, the stabilizer bar 8 is oriented perpendicularly between and attached to both support frames 1 by insertion of the tabs 9 into the base receiving grooves 6 of the support frames 1.

The device further comprises two stabilizer bar fastening knobs 11 each having a threaded male screw 12 at one end. When the device is assembled, the threaded male screw 12 of each stabilizer bar fastening knob 11 is inserted through the base receiving grove 6 of the base 4 of each support frame 1 and screwed into the threaded female screw channel 10 of the stabilizer bar 8 thereby firmly fastening the support frames 1 to the stabilizer bar 8.

The device further comprises, an exercise grip bar 13 having a generally circular cross section, and two grips 14 thereupon made from spongy material such as foam rubber. The exercise grip bar 13 has a threaded female screw channel 10 in the approximate center of each end. When in use, the exercise grip bar 13 is placed by the user into a pair of receiving grooves 5 on the support frames 1. The exercise grip bar 13 is oriented between both support frames 1, and horizontal to the ground.

Two exercise grip bar fastening knobs 15 each having a threaded male screw 12 at one end is screwed into the threaded female screw channel 10 of the exercise grip bar 13 thereby firmly fixing the exercise grip bar 13 to the support frames 1 of the assembled device.

In further detail, still referring to the invention of FIG.1 to FIG.6, the dimensions of the device when assembled are sufficiently tall, deep and wide to accommodate and support the user while performing a variety of exercises. The dimensions of the support frame 1 can be any size but it is envisioned to be about thirty six inches tall, with a base side about thirty three inches long. The dimensions of the stabilizer bar and exercise grip bar are envisioned to be about thirty six inches in length. These dimensions can vary.

Figure 6:
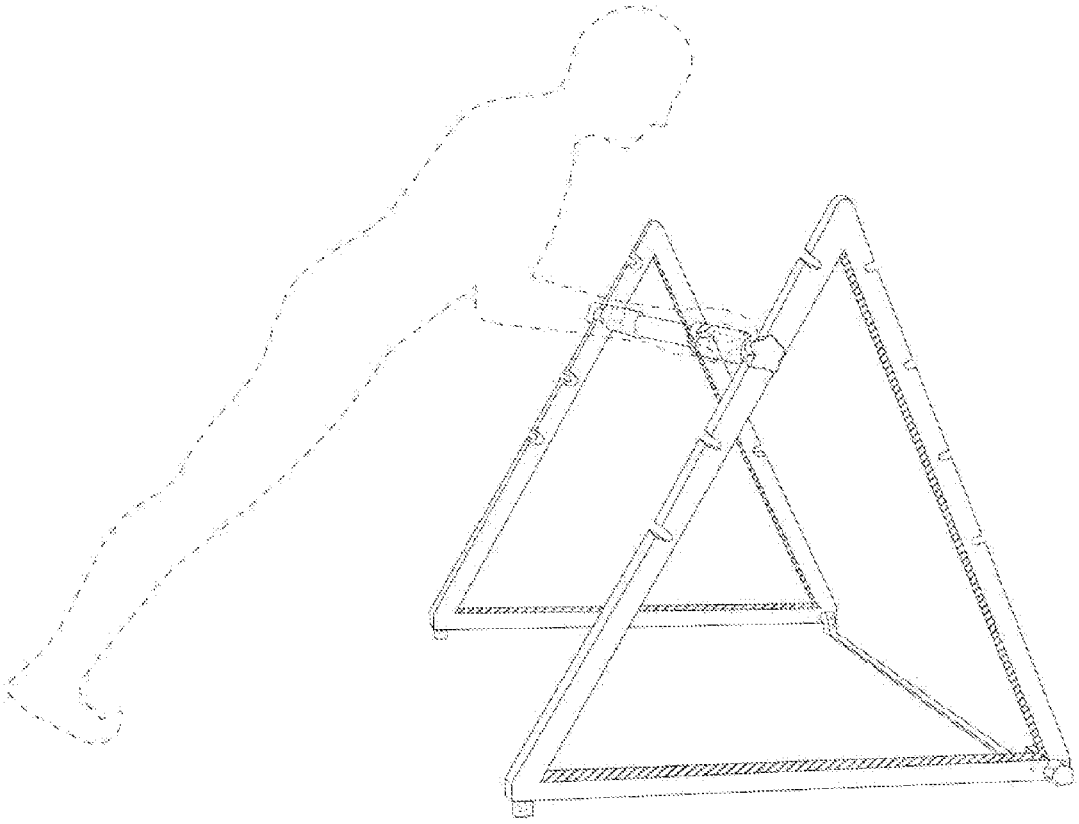
FIG. 6 is a perspective view of a portable adjustable multi-purpose exercise device shown assembled and in use by an individual user.

In more detail, referring to FIG.6, the device is shown in its environment, assembled and in use by an individual performing a desired exercise. The exercise grip bar 13 may be optionally loosed from the support frames 1, repositioned into other receiving grooves 5, and then retightened by the user in order to perform a different exercise.

The previously described versions of the present invention have many advantages including and without limitation, the properties of being i) portable, ii) adjustable, iii) collapsible when not in use, iv) relatively inexpensive, v) allows for a multitude of exercises to be performed for every major part of the body, and vi) focuses on exercises which implement the user's bodyweight as resistance. The device of the present invention is believed to accomplish all of the foregoing objectives. The invention does not require that all the advantageous features and all the advantages need to be incorporated into every embodiment of the invention.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. A portable adjustable multi-purpose exercise device which comprises two support frames which are generally triangular and made from a substantially rigid material, wherein the substantially rigid material is extruded aluminum or hard plastic, said support frames each having a front side, a back side and a base;

four receiving grooves along the length of the front side of the support frames;

four receiving grooves along the length of the back side of the support frames;

a base receiving groove along the length of the base of each support frame;

two rubberized feet attached to the base of each support frame;

a stabilizer bar having a generally flat cross section, said stabilizer bar having a tab on each end, said stabilizer bar having a threaded female screw channel in the approximate center of each tab, said stabilizer bar oriented perpendicularly between and attached to both support frames by insertion of the tabs into the base receiving grooves of the support frames, two stabilizer bar fastening knobs each having a threaded male screw at one end, said threaded male screw of each stabilizer bar fastening knob is inserted through the base receiving grove of the base of each support frame and screwed into the threaded female screw channel of the stabilizer bar thereby firmly fastening the support frames to the stabilizer bar;

an exercise grip bar having a generally circular cross section, said exercise grip bar having two grips along the length of the bar, wherein the grips are made from a spongy material wherein the spongy material is foam rubber, said exercise grip bar having a threaded female screw channel in the approximate center of each end, said exercise grip bar oriented between both support frames and attached by insertion of the ends of the exercise grip bar into any of the receiving grooves of the support frames; and two exercise grip bar fastening knobs each having a threaded male screw at one end, said threaded male screw of each exercise grip bar fastening knob is screwed into the threaded female screw channel of the exercise grip bar thereby firmly fixing the exercise grip bar to the support frames of the assembled device.

* * * * *